US008834594B2

(12) United States Patent
Roder et al.

(10) Patent No.: US 8,834,594 B2
(45) Date of Patent: Sep. 16, 2014

(54) CEMENTED CARBIDE BODY AND APPLICATIONS THEREOF

(75) Inventors: Guenter Johann Roder, Mistelgau (DE); Anders Evert Petersson, Greensburg, PA (US); Charles Graham McNerny, Greensburg, PA (US); Pankaj Kumar Mehrotra, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 124 days.

(21) Appl. No.: 13/333,696

(22) Filed: Dec. 21, 2011

(65) Prior Publication Data

US 2013/0164547 A1 Jun. 27, 2013

(51) Int. Cl.
*B23B 27/14* (2006.01)

(52) U.S. Cl.
USPC ..... 75/236; 75/241; 75/242

(58) Field of Classification Search
USPC ..... 75/236, 241, 242
See application file for complete search history.

(56) References Cited

U.S. PATENT DOCUMENTS

| | | | |
|---|---|---|---|
| 2,113,355 | A | 4/1938 | McKenna |
| 2,731,710 | A | 5/1954 | Lucas et al. |
| 3,994,692 | A | 11/1976 | Rudy |
| 3,999,954 | A | 12/1976 | Kolaska et al. |
| 4,145,213 | A | 3/1979 | Oskarsson et al. |
| 4,276,096 | A | 6/1981 | Kolaska et al. |
| 4,451,292 | A | 5/1984 | Hall et al. |
| 4,843,039 | A | 6/1989 | Akesson et al. |
| 4,963,321 | A | 10/1990 | Saitoh et al. |
| 4,985,070 | A | 1/1991 | Kitamura et al. |
| 5,059,491 | A | 10/1991 | Odani et al. |
| RE34,180 | E | 2/1993 | Nemeth et al. |
| 5,296,016 | A | 3/1994 | Yoshimura et al. |
| 5,395,421 | A | 3/1995 | Weinl et al. |
| 5,447,549 | A | 9/1995 | Yoshimura |
| 5,503,925 | A | 4/1996 | Nakano et al. |
| RE35,538 | E | 6/1997 | Akesson et al. |
| 5,643,658 | A | 7/1997 | Uchino et al. |
| 5,746,803 | A | 5/1998 | Dunmead et al. |
| 5,856,032 | A | 1/1999 | Daub et al. |
| 6,024,776 | A | 2/2000 | Heinrich et al. |
| 6,110,603 | A | 8/2000 | Chen et al. |
| 6,207,262 | B1 | 3/2001 | Ichikawa et al. |

(Continued)

FOREIGN PATENT DOCUMENTS

| | | |
|---|---|---|
| CN | 1425787 A | 6/2003 |
| CN | 1820089 A | 8/2006 |

(Continued)

OTHER PUBLICATIONS

Kyn "Hardmetals with HfZr and NbZr Carbides", R&HM Sep. 1984, p. 142-145.*

(Continued)

*Primary Examiner* — Archene Turner
(74) *Attorney, Agent, or Firm* — Matthew W. Gordon, Esq.

(57) ABSTRACT

In one aspect, cemented carbide bodies are provided. A cemented carbide body described herein, in some embodiments, comprises a tungsten carbide phase, a binder phase comprising at least one metal of the iron group or an alloy thereof, a solid solution phase of carbides of zirconium and niobium (Zr,Nb)C and cubic carbides in an amount ranging from about 0.5 volume percent to about 6 volume percent.

11 Claims, 6 Drawing Sheets

(56) References Cited

U.S. PATENT DOCUMENTS

| | | | | |
|---|---|---|---|---|
| 6,221,479 | B1 | 4/2001 | Waldenstrom et al. | |
| 6,299,658 | B1 | 10/2001 | Moriguchi et al. | |
| 6,756,110 | B2 | 6/2004 | Shibata | |
| 6,761,750 | B2 * | 7/2004 | Zackrisson et al. | 75/242 |
| 6,797,369 | B2 | 9/2004 | Usami et al. | |
| 6,872,234 | B2 | 3/2005 | Shibata | |
| 7,163,657 | B2 | 1/2007 | Heinrich et al. | |
| 7,309,466 | B2 | 12/2007 | Heinrich et al. | |
| 7,544,410 | B2 | 6/2009 | Lengauer et al. | |
| 7,588,620 | B2 * | 9/2009 | Tanibuchi | 75/236 |
| 8,394,169 | B2 * | 3/2013 | Heinrich et al. | 75/242 |
| 2001/0006594 | A1 | 7/2001 | Shibata | |
| 2003/0010166 | A1 | 1/2003 | Shibata | |
| 2003/0129456 | A1 | 7/2003 | Usami et al. | |
| 2005/0224958 | A1 | 10/2005 | Kassel et al. | |

FOREIGN PATENT DOCUMENTS

| | | | |
|---|---|---|---|
| DE | 19752289 | C1 | 4/1999 |
| DE | 19845376 | A1 | 1/2000 |
| DE | 10356470 | A1 | 7/2005 |
| EP | 0360567 | B1 | 7/1997 |
| EP | 0900860 | A2 | 3/1999 |
| EP | 0900860 | A3 | 11/2002 |
| EP | 1 314 790 | * | 5/2003 |
| EP | 0900860 | B1 | 4/2004 |
| JP | 2185941 | A2 | 7/1990 |
| JP | 10237650 | A | 9/1998 |
| JP | 11-124672 | * | 5/1999 |
| JP | 11-131235 | * | 5/1999 |
| JP | 11-140647 | * | 5/1999 |
| JP | 2002356734 | A | 12/2002 |
| RU | 2007491 | | 2/1994 |
| WO | 9624454 | A1 | 8/1996 |

OTHER PUBLICATIONS

Full english translation of JP 2002-356734.*

Nov. 12, 2013—K-4051USDE1—Office_Action.

Akhtar, F. et al., "Effect of WC Particle Size on the Microstructure, Mechanical Properties and Fracture Behavior of WC-(W, Ti, Ta) c-6wt% Co Cemented Carbides," International Journal of Refractory Metals and Hard Metals, Sep. 2007, pp. 405-410, vol. 25, No. 5-6.

Schwarzkofp, M. et al., "Kinetics of Compositional Modification of (W, Ti) C-WC-CO Alloy Surfaces," Materials Science and Engineering A: Structural Materials: Properties, Microstructure & Processing, Jan. 1988, pp. 225-231, vol. A105/106.

PCT Search Report for International Appl. No. PCT/EP2004/011170 dated Apr. 11, 2005; 12 pages.

PCT International Preliminary Report on Patentability, mailed Jun. 15, 2006 for PCT/EP2004/011170, 7 pages.

* cited by examiner (A)

(B)

(C)

(A)

(B)

(C)

(A)

(E)

CEMENTED CARBIDE BODY AND APPLICATIONS THEREOF

FIELD

The present invention relates to cemented carbide bodies and, in particular, to cemented carbide bodies comprising metals from Groups IVB, VB and VIB of the Periodic Table.

BACKGROUND

Cutting tools comprising cemented carbide bodies have been used in both coated and uncoated conditions for machining various metals and alloys. Increasing cutting tool resistance to wear and failure modes, including thermal deformation, fracture and chipping, remains an intense area of research and development. To that end, significant resources have been assigned to the development of wear resistant refractory coatings for cutting tools. TiC, TiCN, TiOCN, TiN and $Al_2O_3$, for example, have been applied to cemented carbides by chemical vapor deposition (CVD) as well as physical vapor deposition (PVD).

Moreover, the properties of the underlying cutting tool substrate have been investigated. Cutting tool manufacturers have examined compositional changes to cemented carbide bodies and the resulting effects on cemented carbide properties including, but not limited to, hardness, wear resistance, thermal deformation resistance, toughness, density and various magnetic properties. Enhancement of one cemented carbide property, however, often results in the concomitant deterioration of another cemented carbide property. For example, increasing the resistance of a cemented carbide body to deformation can result in decreased toughness and thermal conductivity of the body. Japanese patent application publication JP 2002-356734A recognizes such a problem and describes a cemented carbide body having plastic deformation resistance and increased hardness and thermal conductivity. According to JP 2002-356734A, these objectives are achieved by incorporating into the cemented carbide body several differing solid solution phases of carbides, nitrides and carbonitrides of metals selected from Groups IVB, VB and VIB.

Nevertheless, improvements to cemented carbide substrates are necessary to meet the evolving demands of metal working applications, and a careful balance between competing properties is required when making compositional changes to cemented carbide bodies in efforts to provide cutting tools with improved performance.

SUMMARY

In one aspect, cemented carbide bodies are described herein which, in some embodiments, can demonstrate improved resistance to wear and/or one or more failure modes. In some embodiments, for example, a cemented carbide body described herein displays increased resistance to thermal deformation without a substantial loss of toughness.

A cemented carbide body described herein, in some embodiments, comprises a tungsten carbide phase, a binder phase comprising at least one metal of the iron group or an alloy thereof, a solid solution phase of carbides of zirconium and niobium (Zr,Nb)C and cubic carbides in an amount ranging from about 0.5 volume percent to about 6 volume percent. In some embodiments, the cemented carbide body comprises cubic carbides in an amount ranging from about 1 volume percent to about 5.5 volume percent. The cemented carbide body, in some embodiments, comprises cubic carbides in an amount greater than about 2 volume percent to about 5 volume percent. Moreover, in some embodiments, the cubic carbides of the cemented carbide body consist of the zirconium and niobium carbides of the solid solution phase.

A cemented carbide body described herein, in some embodiments, further comprises a coating deposited thereon by physical vapor deposition (PVD), chemical vapor deposition (CVD) or a combination thereof. In some embodiments, the coating comprises one or more metallic elements selected from the group consisting of metallic elements of Groups IVB, VB and VIB of the Periodic Table and aluminum and one or more non-metallic elements selected from the group consisting of non-metallic elements of Groups IIIA, IVA and VIA of the Periodic Table. Groups of the Periodic Table described herein are identified according to the CAS designation. In some embodiments, the coating is a single layer coating. Alternatively, in some embodiments, the coating is a multi-layer coating.

In some embodiments, a cemented carbide body described herein has the shape of a cutting tool for one or more metal working applications. A cemented carbide body, in some embodiments, comprises a rake face and a flank face intersecting the rake face to form a cutting edge.

In another aspect, methods making cemented carbide bodies are described herein. In some embodiments, a method of making a cemented carbide body comprises providing a mixture comprising a tungsten carbide powder, binder powder comprising at least one metal from the iron group or an alloy thereof and a powdered solid solution of carbides of zirconium and niobium (Zr,Nb)C. A green compact is formed of the mixture and sintered to provide the cemented carbide body comprising a tungsten carbide phase, a binder phase, a solid solution phase of (Zr,Nb)C and cubic carbides in an amount ranging from about 0.5 volume percent to about 6 volume percent.

In another aspect, methods of cutting metal are described herein. In some embodiments, a method of cutting metal comprises providing a metal workpiece and cutting the metal workpiece with a cutting tool, the cutting tool comprising a cemented carbide body comprising a tungsten carbide phase, a binder phase comprising at least one metal of the iron group or an alloy thereof, a solid solution phase of carbides of zirconium and niobium (Zr,Nb)C and cubic carbides in an amount ranging from about 0.5 volume percent to about 6 volume percent.

In some embodiments of methods of cutting metal, the cemented carbide body further comprises a coating deposited thereon by physical vapor deposition (PVD), chemical vapor deposition (CVD) or a combination thereof. In some embodiments, the coating comprises one or more metallic elements selected from the group consisting of metallic elements of Groups IVB, VB and VIB of the Periodic Table and aluminum and one or more non-metallic elements selected from the group consisting of non-metallic elements of Groups IIIA, IVA and VIA of the Periodic Table. In some embodiments, the coating is a single layer coating. Alternatively, in some embodiment, the coating is a multi-layer coating.

These and other embodiments are described in greater detail in the detailed description that follows.

DETAILED DESCRIPTION

Figure 1:
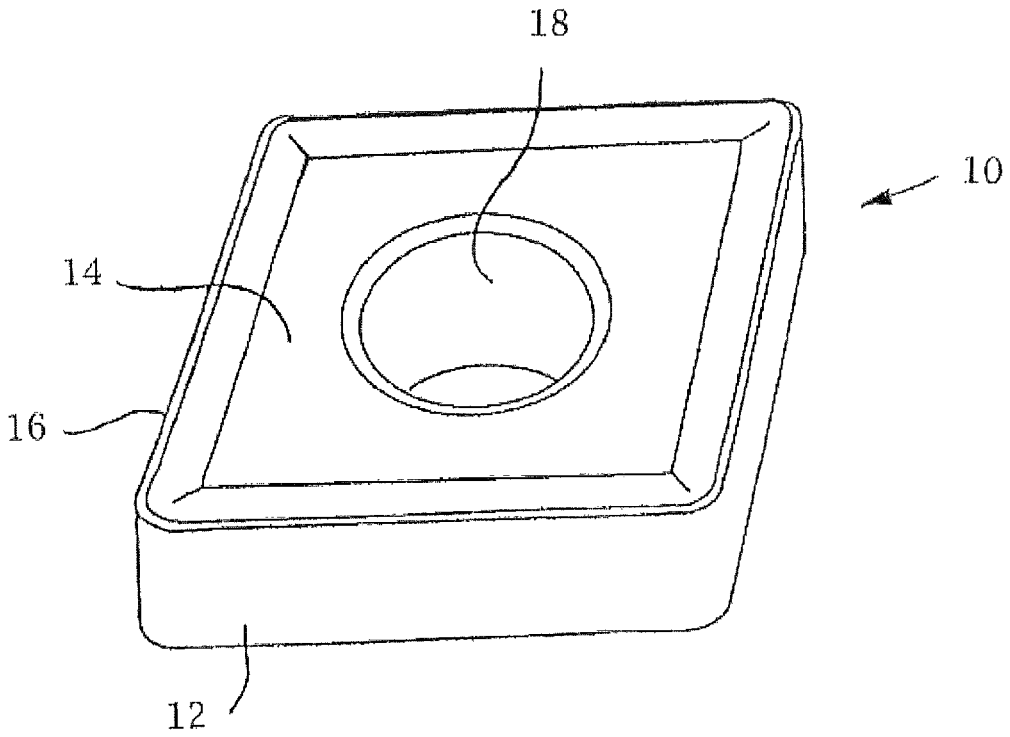
FIG. 1 illustrates a cemented carbide body having the shape of a cutting tool according to one embodiment described herein.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing for the spirit and scope of the invention.

In one aspect, cemented carbide bodies are described herein which, in some embodiments, can demonstrate improved resistance to wear and/or one or more failure modes. In some embodiments, for example, a cemented carbide body described herein displays increased resistance to thermal deformation without a substantial loss of toughness.

A cemented carbide body described herein, in some embodiments, comprises a tungsten carbide phase, a binder phase comprising at least one metal of the iron group or an alloy thereof, a solid solution phase of carbides of zirconium and niobium (Zr,Nb)C and cubic carbides in an amount ranging from about 0.5 volume percent to about 6 volume percent.

Turning now to components of a cemented carbide body, a cemented carbide body described herein comprises a solid solution phase of carbides of zirconium and niobium (Zr,Nb)C. In being formed of carbides of zirconium and niobium, the solid solution phase, in some embodiments, does not comprise one or more additional metallic elements in excess of trace or impurity amounts. Moreover, in some embodiments, the solid solution phase of (Zr,Nb)C is the sole solid solution phase of the cemented carbide body. Therefore, in some embodiments, a cemented carbide body described herein does not comprise one or more additional solid solution phases of carbides, nitrides and/or carbonitrides of metals of Groups IVB, VB and VIB of the Periodic Table. In some embodiments, for example, a cemented carbide body described herein does not include a solid solution phase comprising a carbide, nitride and/or carbonitride of titanium, hafnium, vanadium, tantalum, tungsten, molybdenum or chromium or mixtures thereof.

In some embodiments, niobium is present in a cemented carbide body described herein in an amount ranging from about 0.5 mass percent to about 1.5 mass percent. Niobium, in some embodiments, is present in an amount ranging from about 0.7 mass percent to about 1.3 mass percent. In some embodiments, niobium is present in an amount ranging from about 0.8 mass percent to about 1 mass percent. Additionally, in some embodiments, zirconium is present in the cemented carbide body in an amount ranging from about 0.3 mass percent to about 1 mass percent. In some embodiments, zirconium is present in an amount ranging from about 0.5 mass percent to about 0.7 mass percent. A cemented carbide body, in some embodiments, has a mass ratio of $Nb/(Nb+Zr) \geq 0.5$. In some embodiments, the foregoing mass ratio is greater than or equal to 0.6. The mass ratio, in some embodiments, is greater than or equal to 0.7.

A cemented carbide body described herein also comprises cubic carbides in an amount ranging from about 0.5 volume percent to about 6 volume percent. In some embodiments, cubic carbides are present in the cemented carbide body in an amount ranging from about 1 volume percent to about 5 volume percent. In some embodiments, cubic carbides are present in an amount ranging from greater than 2 volume percent to 5 volume percent. In some embodiments, cubic carbides are present in an amount ranging from about 2.5 volume percent to about 4 volume percent.

In some embodiments, cubic carbides of the cemented carbide body consist of the carbides of niobium and zirconium of the solid solution phase (Zr,Nb)C. Therefore, in some embodiments, cubic carbides of the cemented carbide body do not comprise one or more additional metals of Groups IVB, VB and VIB of the Periodic Table in excess of trace or impurity amounts. In some embodiments, for example, cubic carbides of the cemented carbide body do not comprise titanium, tantalum or mixtures thereof in more than trace or impurity amounts.

A cemented carbide body described herein also comprises a tungsten carbide (WC) phase. In some embodiments, particles of the tungsten carbide phase demonstrate a grain size distribution ranging from about 1 μm to about 12 μm. In some embodiments, the particles of the tungsten carbide phase have a particle size distribution ranging from about 2 μm to about 10 μm.

Moreover, the binder phase of a cemented carbide body described herein comprises at least one metal of the iron group or an alloy thereof. In some embodiments, for example, the binder phase comprises cobalt. In some embodiments, the binder phase comprises a cobalt-nickel alloy or a cobalt-nickel-iron alloy. Additional alloying elements, such as chromium and/or tungsten, can be included in the binder phase. The binder phase, in some embodiments, is present in the cemented carbide body in an amount ranging from about 5 mass percent to about 15 mass percent. In some embodiments, the binder phase is present in an amount ranging from about 7 mass percent to about 13 mass percent. In some embodiments, the binder phase is present in an amount ranging from about 9 mass percent to about 12 mass percent.

A cemented carbide body described herein, in some embodiments, does not comprise a binder enriched zone including, but not limited to, a binder enriched surface zone. In some embodiments, for example, a cemented carbide body does not comprise a binder enriched surface zone being free or substantially free of cubic carbides and/or the (Zr,Nb)C solid solution phase.

A cemented carbide body described herein, in some embodiments, further comprises a coating deposited thereon by physical vapor deposition (PVD), chemical vapor deposition (CVD) or a combination thereof. In some embodiments, the coating comprises one or more metallic elements selected from the group consisting of metallic elements of Groups IVB, VB and VIB of the Periodic Table and aluminum and one or more non-metallic elements selected from the group consisting of non-metallic elements of Groups IIIA, IVA and VIA of the Periodic Table. In some embodiments, for example, the coating comprises one or more carbides, nitrides, carbonitrides, oxides or borides of a metallic element selected from the group consisting of metallic elements of Groups IVB, VB and VIB of the Periodic Table and aluminum.

Additionally, in some embodiments, the coating is a single layer coating. Alternatively, in some embodiments, the coating is a multi-layer coating. In some embodiments, for example, a multi-layer coating comprises a TiCN layer adjacent to the cemented carbide body followed by an outer layer of alumina ($Al_2O_3$). In some embodiments, the TiCN layer is a medium temperature (MT) TiCN layer while the alumina layer is an α-alumina layer, κ-alumina layer or mixture thereof. Further, in some embodiments, a single layer coating or multi-layer coating can be subjected to one or more post-coat treatment processes such as post-coat blasting. In some embodiments, a post-coat blasting treatment is administered in accordance with the disclosure of U.S. Pat. No. 6,869,334, which is incorporated herein by reference in its entirety.

A cemented carbide body described herein, in some embodiments, has a hardness (HV30) ranging from about 1200 to about 1600, wherein HV30 refers to Vickers Hardness using a 30 kilogram-force load. In some embodiments, a cemented carbide body has a hardness ranging from about 1200 to about 1500 HV30 or from about 1200 to about 1460 HV30. In some embodiments, a cemented carbide body has a hardness ranging from about 1250 to about 1400 HV30. A cemented carbide body, in some embodiments, has a hardness ranging from about 1280 to about 1380 HV30. Vickers hardness values recited herein are determined according to ASTM E 384, "Standard Method for Knoop and Vickers Hardness of Materials," ASTM International.

Moreover, in some embodiments, a cemented carbide body described herein has a coercivity ranging from about 120 Oe to about 170 Oe. In some embodiments, a cemented carbide body has a coercivity ranging from about 130 Oe to about 160 Oe. A cemented carbide body, in some embodiments, has a coercivity ranging from about 135 Oe to about 150 Oe. Coercivity values recited herein are determined according to ASTM B887, "Standard Test Method for Determination of Coercivity (Hcs) of Cemented Carbides," ASTM International.

In some embodiments, a cemented carbide body described herein has a magnetic saturation (Ms) ranging from about 75% to about 95%. A cemented carbide body, in some embodiments, has a magnetic saturation ranging from about 79% to about 89%. In some embodiments, a cemented carbide body has a magnetic saturation ranging from about 80% to about 85%. Magnetic saturation values recited herein are determined according to ASTM B 886, "Standard Test Method for Determination of Magnetic Saturation (Ms) of Cemented Carbides," ASTM International. As known to one of skill in the art, magnetic saturation values may be converted from percentages to $\mu Tm^{-3}/kg$ based on comparison to a nominally pure Co binder phase. For example, see Roebuck, B. Magnetic Moment (Saturation) Measurements on Hardmetals, *Int. J. Refractory Metals & Hard Materials,* 14 (1996) 419-424.

Additionally, a cemented carbide body described herein has a density ranging from about 12.5 $g/cm^{-3}$ to about 15.0 $g/cm^{-3}$. In some embodiments, a cemented carbide body has a density ranging from about 13.0 $g/cm^{-3}$ to about 14.5 $g/cm^{-3}$. In some embodiments, a cemented carbide body has a density ranging from about 14.1 $g/cm^{-3}$ to about 14.4 $g/cm^{-3}$.

A cemented carbide body described herein can have any combination of the foregoing properties. For example, a cemented carbide body can comprise any value of hardness, coercivity, magnetic saturation and density recited herein.

In some embodiments, a cemented carbide body has the shape of a cutting tool. A cemented carbide body, in some embodiments, comprises a rake face and a flank face intersecting with the rake face to form a cutting edge. FIG. 1 illustrates a cemented carbide body having the shape of a cutting tool according to one embodiment described herein. As illustrated in FIG. 1, the cemented carbide body (10) comprises a flank face (12) and a rake face (14), wherein the flank (12) and rake (14) faces intersect to provide a cutting edge (16). The cemented carbide body (10) also comprises an aperture (18) operable to secure the body (10) to a tool holder.

In another aspect, methods of making cemented carbide bodies are described herein. In some embodiments, a method of making a cemented carbide body comprises providing a mixture comprising a tungsten carbide powder, binder powder comprising at least one metal from the iron group or an alloy thereof and a powdered solid solution of carbides of zirconium and niobium (Zr,Nb)C. A green compact is formed of the mixture and sintered to provide the cemented carbide body comprising a tungsten carbide phase, a binder phase, a solid solution phase of (Zr,Nb)C and cubic carbides in an amount ranging from about 0.5 volume percent to about 6 volume percent. The tungsten carbide phase, binder phase, solid solution phase of (Zr,Nb)C and cubic carbides can have any of the properties recited hereinabove for such phases. In some embodiments, for example, the solid solution of phase of (Zr,Nb)C is the sole solid solution phase of the cemented carbide body as described herein. Moreover, the cubic carbides, in some embodiments, consist of the carbides of niobium and zirconium of the solid solution phase.

In some embodiments of methods described herein, metals of the powdered mixture are provided in amounts commensurate with their desired compositional percentages of the sintered cemented carbide body. In some embodiments, for example, binder powder comprising at least one metal from the iron group or an alloy thereof is provided to the mixture in an amount ranging from about 5 mass percent to about 15 mass percent. Binder powder, in some embodiments, is provided to the mixture in an amount ranging from about 7 mass percent to about 13 mass percent. In some embodiments, binder powder is provided to the mixture in an amount ranging from about 9 mass percent to about 12 mass percent.

Moreover, in some embodiments, solid solution powder of carbides of niobium and zirconium (Zr,Nb)C is added to the mixture in an amount sufficient to provide a niobium content ranging from about 0.5 mass percent to about 1.5 mass percent and a zirconium content ranging from about 0.3 mass percent to about 1 mass percent. In some embodiments, (Zr,Nb)C solid solution powder is added to the mixture in an amount sufficient to provide a niobium content ranging from about 0.7 mass percent to about 1.3 mass percent and a zirconium content ranging from about 0.5 mass percent to about 0.7 mass percent. A (Zr,Nb)C solid solution powder for use in some embodiments of methods described herein has a mass ratio $Nb/(Nb+Zr) \geq 0.5$. In some embodiments, the foregoing mass ratio is greater than or equal to 0.6. The mass ratio, in some embodiments, is greater than or equal to 0.7.

Tungsten carbide powder, in some embodiments, serves as the balance of the mixture used to form cemented carbide bodies described herein.

The green compact can be sintered under any conditions not inconsistent with the objectives of the present invention to provide a cemented carbide body described herein. In some embodiments, for example, the green compact is vacuum sintered or sintered-hot isostatic press (HIP) at a temperature ranging from about 1400° C. to about 1560° C. In some embodiments, the green compact is sintered for a time period ranging from about 15 minutes to about 120 minutes. In some embodiments, the green compact is sintered for a time period ranging from about 15 minutes to about 90 minutes or from about 30 minutes to about 75 minutes.

A method of making a cemented carbide body, in some embodiments, further comprises depositing a coating on the cemented carbide body by PVD, CVD or a combination thereof. In some embodiments, the coating comprises one or more metallic elements selected from the group consisting of metallic elements of Groups IVB, VB and VIB of the Periodic Table and aluminum and one or more non-metallic elements selected from the group consisting of non-metallic elements of Groups IIIA, IVA and VIA of the Periodic Table. In some embodiments, for example, the coating comprises one or more carbides, nitrides, carbonitrides, oxides or borides of a metallic element selected from the group consisting of metallic elements of Groups IVB, VB and VIB of the Periodic Table and aluminum. Additionally, in some embodiments, the coating is a single layer coating. Alternatively, in some embodiments, the coating is a multi-layer coating.

In another aspect, methods of cutting metal are described herein. In some embodiments, a method of cutting metal comprises providing a metal workpiece and cutting the metal workpiece with a cutting tool, the cutting tool comprising a cemented carbide body comprising a tungsten carbide phase, a binder phase comprising at least one metal of the iron group or an alloy thereof, a solid solution phase of carbides of zirconium and niobium (Zr,Nb)C and cubic carbides in an amount ranging from about 0.5 volume percent to about 6 volume percent. In some embodiments of methods of cutting metal, the cemented carbide body can have any of the properties described herein for a cemented carbide body. Moreover, in some embodiments, the cemented carbide body further comprises a coating as described herein.

In some embodiments, the metal work piece comprises plain and alloyed steel, stainless steel, gray cast iron, gray cast iron with nodular graphite and various high temperature alloys.

These and other embodiments are further illustrated by the following non-limiting examples.

EXAMPLE 1

Cemented Carbide Bodies

Powder mixture (A), in accordance with one embodiment described herein, having the metal compositional parameters provided in Table I was pressed to form a green compact having an ANSI standard geometry of CNMG120408 RP. As provided in Table I, (ZrNb)C solid solution powder was added to the mixture in an amount sufficient to provide a niobium content of 0.93 mass percent and a zirconium content of 0.62 mass percent. Tungsten carbide (WC) powder constituted the balance of mixture after the addition of 10.6 mass percent cobalt. The green compact was vacuum sintered at a temperature ranging from 1400° C.-1560° C. for a time period of 30-60 minutes to provide a cemented carbide body.

TABLE I

Powder Mixture of Cemented Carbide Body (mass percent)

| Example | Cobalt | Chromium | Tantalum (TaC) | Niobium/ Zirconium* | Tungsten (WC) |
|---|---|---|---|---|---|
| A | 10.6 | — | — | 0.93/0.62 | Balance |

*As (ZrNb)C Solid Solution with mass ratio Nb/(Nb + Zr) ≥ 0.5

Powder mixtures (B-E) having the metal compositional parameters provided in Table II were also pressed to form green compacts of insert geometry CNMG120408 RP and sintered in a manner consistent with that of powder mixture A to provide comparative cemented carbide bodies.

TABLE II

Powder Mixtures of Comparative Cemented Carbide Bodies (mass percent)

| Example | Cobalt | Chromium | Tantalum (TaC)* | Niobium (NbC)* | Zirconium (ZrC) | Tungsten (WC) |
|---|---|---|---|---|---|---|
| B | 11.5 | 0.40 | — | — | — | Balance |
| C | 10.0 | 0.35 | — | — | — | Balance |
| D | 10.5 | — | 1.7 | 0.83 | — | Balance |
| E | 10.5 | — | 1.1 | 0.27 | — | Balance |

*Provides a (TaNb)C solid solution powder

As provided in Table II, (TaNb)C solid solution powder in Examples D and E was added to the mixture in an amount sufficient to provide the tantalum and niobium mass percents. WC powder constituted the balance of the powder mixture after the addition of 10.5 mass percent cobalt. For examples B and C, WC powder also constituted the balance of the mixture after the addition of the cobalt and chromium mass percents.

Cemented carbide body examples A-E were provided a multilayer coating consisting of a titanium carbonitride (TiCN) inner layer and an α-alumina outer layer deposited by chemical vapor deposition (CVD), wherein the coating thickness for each example is provided in Table III below. Cemented carbide body examples A-E were subsequently subjected to the various ASTM testing procedures recited herein, the results of which are also provided in Table III.

TABLE III

Properties of Cemented Carbide Bodies

| Example | Density ($g/cm^3$) | Magnetic Saturation ($0.1\ \mu Tm^{-3}/kg$) | Coercivity (Oe) | Hardness (HV30) | Coating Thickness (μm) |
|---|---|---|---|---|---|
| A | 14.10 | 181 | 143 | 1331 | 7.0 |
| B | 14.19 | 191 | 146 | 1316 | 7.7 |
| C | 14.33 | 167 | 143 | 1351 | 7.7 |
| D | 14.22 | 179 | 147 | 1321 | 8.8 |
| E | 14.35 | 181 | 148 | 1327 | 8.3 |

EXAMPLE 2

Deformation Testing

Cemented carbide bodies made in accordance with examples A-E of Example 1 were subjected to a deformation turning test under the following conditions:

Workpiece—42CrMo4 (1.7225)

Cutting Speed—270, 285, 300, 315 and 330 m/min

Cutting time—5 seconds per cutting speed

Feed rate—0.3 mm/rev.

Depth of Cut—2.5 mm
Coolant—none
Cutting Insert Holder—MCLNL3225P12

The average nose wear (mm) of cemented carbide body examples A-E at a cutting speed of 315 m/min over three repetitions is provided in Table IV. The cutting speed of 315 m/min was reached after the cemented carbide body examples A-E progressed through cutting speeds 270, 285 and 300 m/min. In some cases, a cemented carbide cutting tool reached end of life (EOL) prior to or during application of the 315 m/min cutting speed. EOL was determined by plastic deformation resulting from thermal overloading as demonstrated by nose wear ≥0.6 mm and/or coating flaking.

TABLE IV

Average Nose Wear (mm) at Cutting Speed of 315 m/min

| Example | REP1 | REP2 | REP3 | Average |
|---|---|---|---|---|
| A | 0.295 | 0.293 | 0.364 | 0.320 |
| B | EOL | 0.520 | EOL | >0.5 |
| C | 0.438 | 0.361 | 0.327 | 0.380 |
| D | 0.247 | 0.347 | 0.357 | 0.320 |
| E | 0.417 | 0.360 | 0.433 | 0.400 |

As provided in Table IV, the cemented carbide bodies of example A, having compositional parameters and properties described herein, demonstrated the highest resistance to nose wear, thereby exceeding comparative examples B, C and E while matching the performance of comparative example D.

Figure 2:
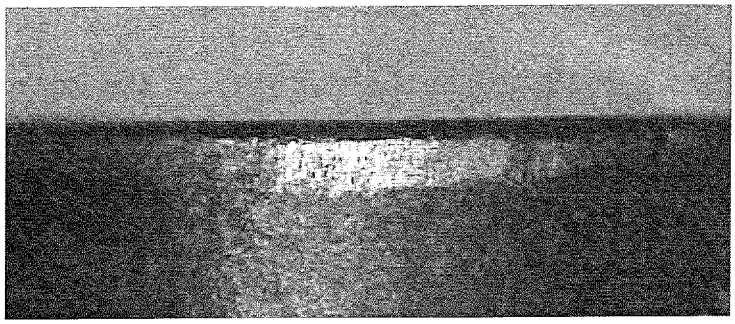
FIG. 2 illustrates results of deformation testing of a cemented carbide body according to one embodiment described herein in view of comparative cemented carbide bodies.
Figure 2:
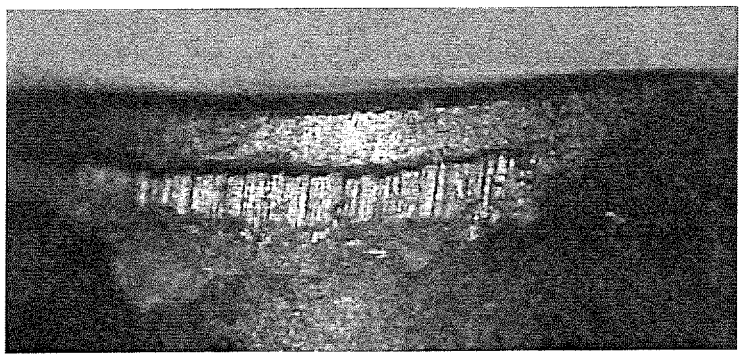
Figure 2:
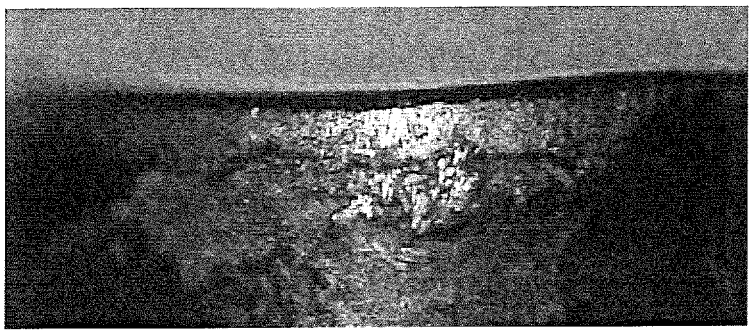

Furthermore, the cemented carbide bodies of example A demonstrated desirable resistance to thermal deformation in view of the comparative examples. As illustrated in FIG. 2, the cemented carbide body of example A displayed significantly less thermal deformation in comparison with examples B and C at the cutting speed of 285 m/min. Coating flaking, for example, was significant for examples B and C while substantially non-existent for example A.

EXAMPLE 3

Toughness Testing

Cemented carbide bodies made in accordance with examples A-E of Example 1 were subjected to a toughness turning test under the following conditions:
Workpiece—CK60 (1.1221)
Cutting Speed—100 m/min
Feed rate—0.4, 0.5, 0.6, 0.7, 0.8 mm/rev
Impacts per feed rate—100
Depth of Cut—2.5 mm
Coolant—none
Cutting Insert Holder—MCLNL3225P12

Figure 3:
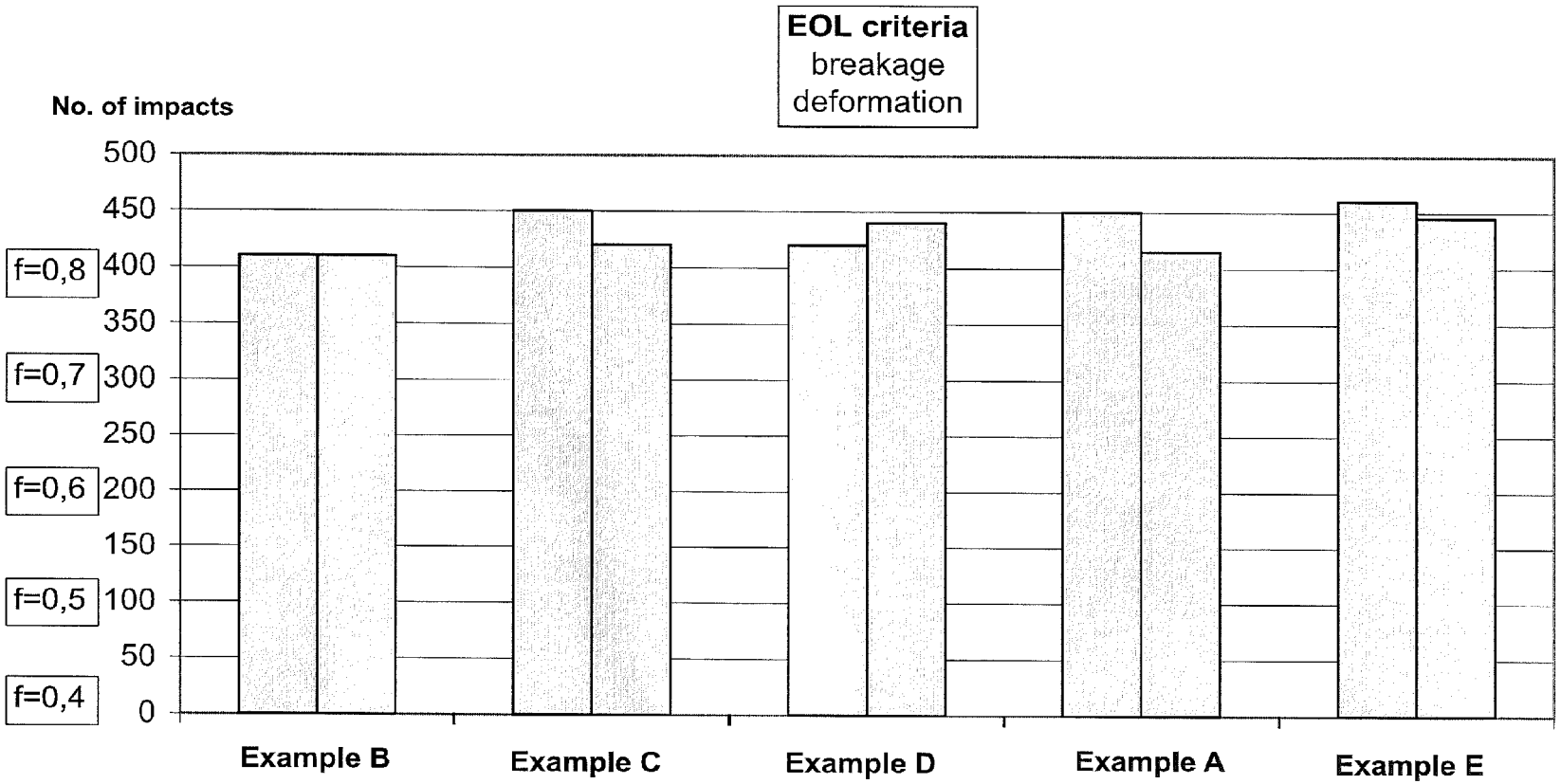
FIG. 3 illustrates results of toughness testing of a cemented carbide body according to one embodiment described herein in view of comparative cemented carbide bodies.

The results of the toughness testing of cemented carbide body examples A-E over two repetitions is provided in FIG. 3. The criteria for EOL were cemented carbide body breakage and/or plastic deformation resulting from thermal overloading as demonstrated by nose wear ≥0.6 mm and/or coating flaking. As displayed in FIG. 3, cemented carbide bodies of example A demonstrated comparable toughness to comparative examples B-E.

EXAMPLE 4

Interrupted Cut Testing

Cemented carbide bodies made in accordance with examples A-E of Example 1 were subjected to an interrupted cut turning test under the following conditions:
Workpiece—42CrMo4 (1.7225)
Cutting Speed—160 m/min
Cutting time—Up to 4 minutes or until tool failure
Feed rate—0.3 mm/rev for 3 minutes, 0.35 mm/rev from 3-4 minutes
Depth of Cut—3 mm
Coolant—yes
Cutting Insert Holder—MCLNL3225P12

Figure 4:
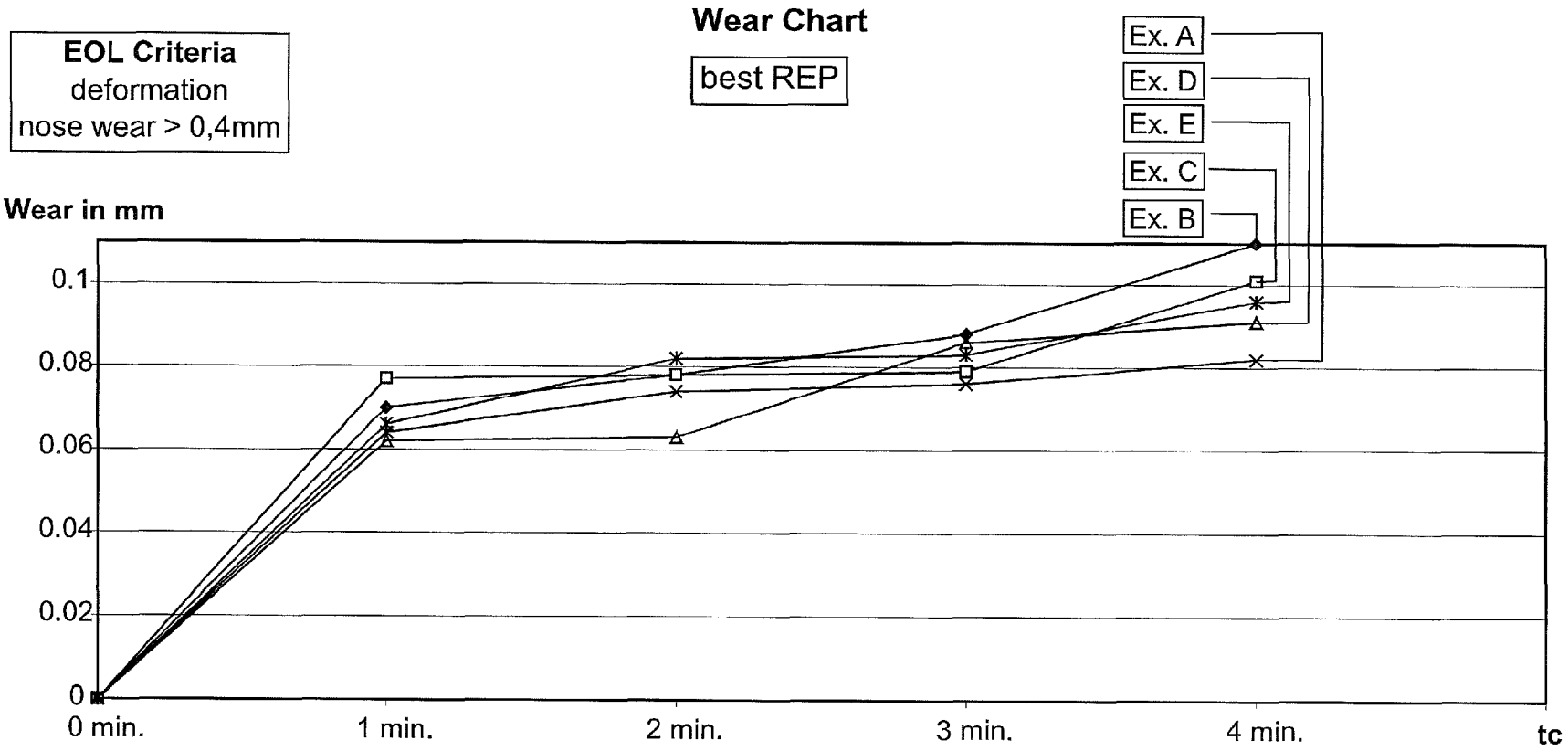
FIG. 4 illustrates results of interrupted cut testing of a cemented carbide body according to one embodiment described herein in view of comparative cemented carbide bodies.
Figure 5:
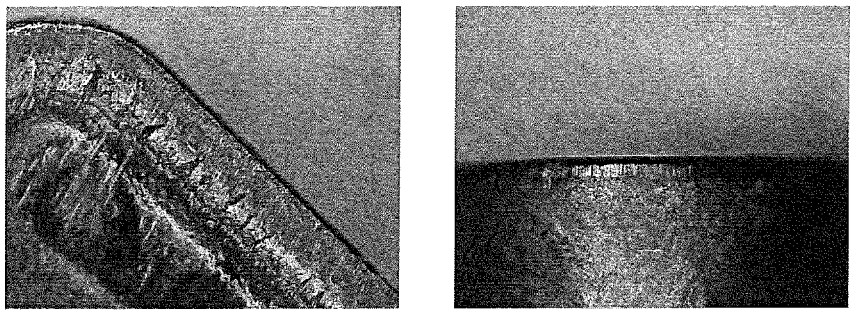
FIG. 5 illustrates results of interrupted cut testing of a cemented carbide body according to one embodiment described herein in view of comparative cemented carbide bodies.
Figure 5:
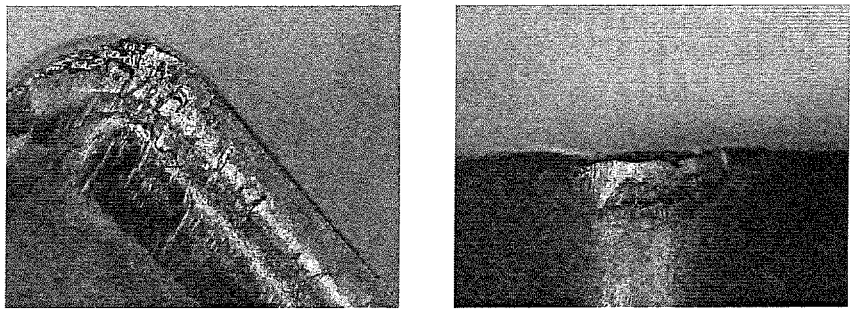
Figure 5:
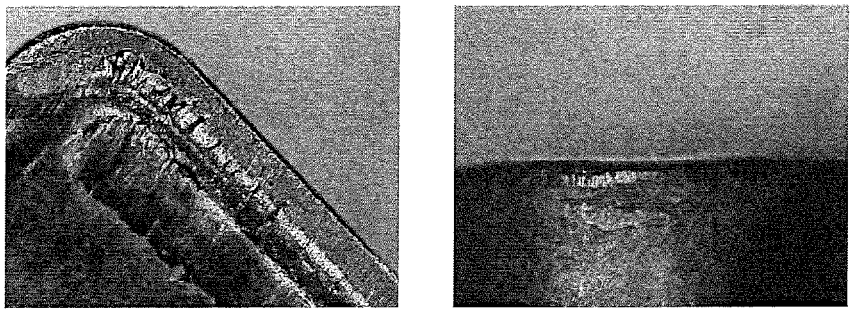

FIG. 4 illustrates results of the interrupted cut testing, wherein the best performance taken from five repetitions for each of examples A-E is provided. The EOL criteria were nose wear >0.4 mm and/or plastic deformation resulting from thermal overloading as evidenced by coating flaking in conjunction with the nose wear >0.4 mm. As illustrated in FIG. 4, the cemented carbide body of Example A demonstrated the highest resistance to wear. FIG. 5 further illustrates the enhanced wear resistant characteristics of the cemented carbide body of example A in comparison with examples B and C.

EXAMPLE 5

Milling Testing

Powder mixtures (A) and (B-E) provided in Tables I and II of Example 1 were each pressed to form a green compact having an ANSI standard geometry of SEKN1203AFSN3 and vacuum sintered at a temperature ranging from 1400° C.-1560° C. for a time period of 30-60 minutes to provide cemented carbides body examples A-E.

Cemented carbide body examples A-E were provided a multi-layer coating consisting of a TiCN inner layer and an α-alumina outer layer, wherein the thickness of the coating for each example was about 9 μm. The cemented carbide body examples A-E were subsequently subjected to a face milling test having the following conditions:
Workpiece—42CrMo4V
Cutting Speed—250 m/min
Feed per tooth—0.3 mm
Axial Depth of Cut—2.0 mm
Radial Depth of Cut—120 mm
Coolant—None
Machine—Heller PFH 12-1400
Tooling Adapter—SK 50

The average cutting length until EOL of cemented carbide body examples A-E over three repetitions is provided in Table V. EOL criteria were flank wear greater than 0.3 mm and/or plastic deformation by thermal overloading as evidenced by coating flaking in conjunction with flank wear greater than 0.3 mm.

TABLE V

Average Cutting Length (mm) Prior to EOL

| Example | REP 1 | REP 2 | REP 3 | Stdev | Average |
|---|---|---|---|---|---|
| A | 1009 | 800 | 962 | 110 | 924 |
| B | 118 | 115 | 125 | 5 | 119 |
| C | 365 | 370 | 360 | 5 | 365 |
| D | 669 | 903 | 800 | 117 | 794 |
| E | 790 | 738 | 800 | 33 | 776 |

As provided in Table V, the cemented carbide bodies of example A, having compositional parameters described herein, had the longest cut length, thereby demonstrating increased resistance to thermal deformation without a loss in toughness under the foregoing severe milling conditions.

Figure 6:
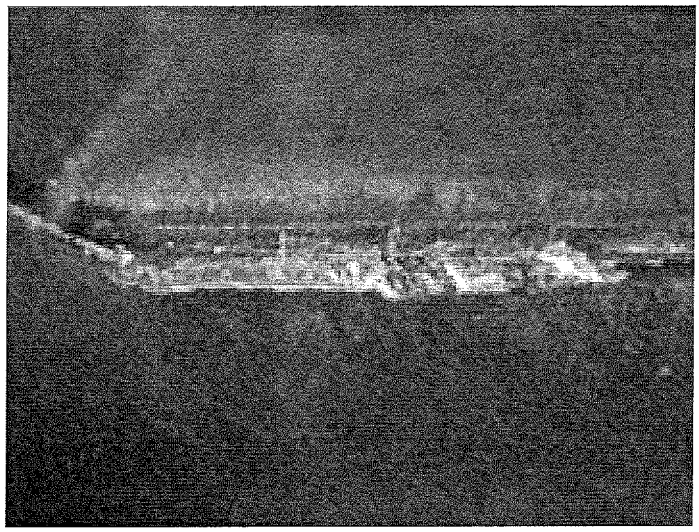
FIG. 6 illustrates results of milling testing of a cemented carbide body according to one embodiment described herein in view of a comparative cemented carbide body.
Figure 6:
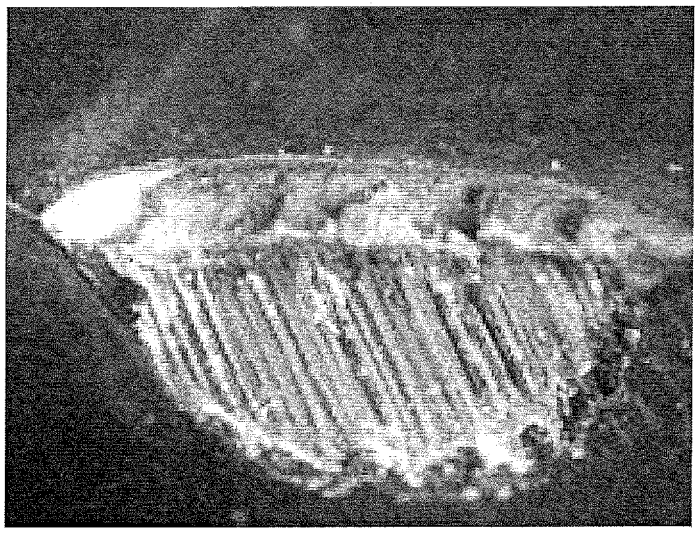

FIG. 6 further illustrates the enhanced performance of the cemented carbide body of example A in comparison to the comparative cemented carbide body of example E. At approximately equal cutting lengths of 800 mm, the cemented carbide body of example E displayed significant coating flaking on the rake face, crater wear and deformation in comparison to the wear of example A.

EXAMPLE 6

Milling Testing

The milling test of Example 5 was repeated wherein the only deviation was an alteration of the cutting speed from 250 m/min to 200 m/min. The results of the testing are provided in Table VI.

TABLE VI

| Average Cutting Length (mm) Prior to EOL | | | | | |
|---|---|---|---|---|---|
| Example | REP 1 | REP 2 | REP 3 | Stdev | Average |
| A | 4000 | 4000 | 4800 | 462 | 4267 |
| B | 932 | 485 | 400 | 286 | 606 |
| C | 1600 | 2800 | 2000 | 611 | 2133 |
| D | 2800 | 2800 | 4400 | 924 | 3333 |
| E | 2800 | 2800 | 4000 | 693 | 3200 |

As provided in Table VI, the cemented carbide bodies of example A, having compositional parameters described herein, had the longest cut length, thereby demonstrating increased thermal deformation resistance without a loss in toughness under the foregoing severe milling conditions.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. A cemented carbide body comprising:

a tungsten carbide phase;

a binder phase comprising at least one metal of the iron group or an alloy thereof;

a solid solution phase of carbides of zirconium and niobium (Zr,Nb)C; and cubic carbides in an amount ranging from about 0.5 volume percent to about 6 volume percent, wherein the solid solution phase of (Zr,Nb)C is the sole solid solution phase of the cemented carbide body and (Zr,Nb)C are the only cubic carbides present in the cemented carbide body, the cemented carbide body having a mass ratio of $Nb/(Nb+Zr) \geq 0.6$.

2. The cemented carbide body of claim 1, wherein the cubic carbides are present in an amount ranging from greater than 2 volume percent to 5 volume percent.

3. The cemented carbide body of claim 1, wherein the binder phase is present in an amount ranging from about 5 mass percent to about 15 mass percent.

4. The cemented carbide body of claim 1, wherein the binder phase comprises cobalt, a cobalt-nickel alloy or a cobalt-nickel-iron alloy.

5. The cemented carbide body of claim 1, wherein the body does not comprise a binder enriched zone.

6. The cemented carbide body of claim 1 having a hardness ranging from about 1200 to about 1600 HV30.

7. The cemented carbide body of claim 1 having a hardness ranging from about 1280 to about 1380 HV30.

8. The cemented carbide body of claim 1 having a coercivity ($H_{cs}$) ranging from about 120 Oe to about 170 Oe.

9. The cemented carbide body of claim 1 having a coercivity ranging from about 130 Oe to about 160 Oe.

10. The cemented carbide body of claim 1, wherein Nb is present in an amount ranging from about 0.5 mass percent to about 1.5 mass percent.

11. The cemented carbide body of claim 1, wherein Zr is present in an amount ranging from about 0.3 mass percent to about 1 mass percent.

* * * * *